US005889260A

United States Patent [19]

Golan et al.

[11] Patent Number: 5,889,260

[45] Date of Patent: Mar. 30, 1999

[54] ELECTRICAL PTC HEATING DEVICE

[75] Inventors: Gad Golan, Hod Hasharon; Yuly Galperin, Holon, both of Israel

[73] Assignee: Body Heat Ltd., Ariel, Israel

[21] Appl. No.: 976,594

[22] Filed: Nov. 24, 1997

[30] Foreign Application Priority Data

Aug. 1, 1997 [IL] Israel ..... 121448

[51] Int. Cl.[6] ..... H05B 1/02

[52] U.S. Cl. ..... 219/505; 219/504; 219/530; 219/532; 392/360; 392/365

[58] Field of Search ..... 219/505, 530, 219/540, 541, 544, 536, 537; 338/22 R

[56] References Cited

U.S. PATENT DOCUMENTS 5,198,640 3/1993 Yang ..... 219/530

5,377,298 12/1994 Yang ..... 392/360

5,710,459 1/1998 Teng et al. ..... 257/717

FOREIGN PATENT DOCUMENTS 2-191303 7/1990 Japan .

*Primary Examiner*—Mark H. Paschall
*Assistant Examiner*—Vinod D. Patel
*Attorney, Agent, or Firm*—Nixon & Vanderhye, P.C.

[57] ABSTRACT

An electrical heating device employing positive temperature coefficient (PTC) thermistors as heating elements, which provides direct contact between the thermistor heating elements and the radiation units on both sides with no intervening members and which also provides the electrical current to the heating elements via the radiation units.

4 Claims, 3 Drawing Sheets

ELECTRICAL PTC HEATING DEVICE

FIELD OF THE INVENTION

The present invention relates to electrical heating devices, particularly those employing thermistors with positive temperature coefficient of resistance (PTC) as heating elements.

BACKGROUND OF THE INVENTION

Positive temperature coefficient (PTC) heating elements, such as thermistors, are used in electrical heating devices, such as electrical radiators, electrical heating fans, and air conditioner heaters. They have an advantage over electric wire heaters in that they are self-regulating as to temperature and thus are not subject to overheating even in response to abnormal electric currents. In many prior art applications employing PTC thermistor heating elements, heat is extracted from the device by air flow through the device, including the heating elements and radiating elements, such as radiating fins. The direct exposure of the PTC elements to the air flow fed to the heating device, however, also exposes these elements to dust, which causes deterioration of their heating ability and efficiency. A further disadvantage of direct exposure of the PTC elements to air flow is the temperature variation between the leeward and windward sides, which reduces heating efficiency and generating power due to the "pinch effect" (current displacement).

U.S. Pat. No. 4,954,692 discloses a heating device employing PTC thermistor heating elements placed in a locating frame made of electric insulating material and located between two radiators provided with flanges which enclose the heating elements, thereby protecting them from direct exposure to air flow. The PTC thermistor heating elements are separated from at least one of the radiators by a plate that is both electrically insulating and heat conducting. Electrical contact with the PTC thermistor is provided by a metallic plate installed between the heating elements and an electric insulating plate. Among the disadvantages of the device disclosed is the requirement of two additional plates between the heating elements and one of the radiators, thereby reducing the efficiency of heat transfer from the heating elements to the radiators and making the device more complicated and more expensive. The requirement of a plate that is both electrically insulating and heat conducting is a further complication and expense.

SUMMARY OF THE INVENTION

The present invention seeks to provide an electrical heating device employing positive temperature coefficient (PTC) thermistors as heating elements, which overcomes disadvantages of known art by providing direct contact between the thermistor heating elements and the radiation units on both sides with no intervening members and by also providing the electrical current to the heating elements via the radiation units. These features allow a heating device with a minimal number of components and a simpler design in comparison with known art.

There is thus provided, in accordance with a preferred embodiment of the invention, an electrical heating device employing one or more positive temperature coefficient (PTC) thermistors as heating elements. These heating elements are in direct thermal and electrical contact on opposing sides, which are coated with a conductive metal such as aluminum, with heat radiation units which include cooling fins for heat transfer and electrodes to supply electrical current. The heating elements are positioned by an electrically and thermally insulating frame which serves, together with the radiation units, to fully enclose the heating elements, thereby protecting them from exposure to air or gas flow, and, hence, from the known "pinch effect." The heating elements are further held in place and in good thermal and electrical contact with the heat radiation units by mechanical pressure or by a thermally and electrically conductive adhesive.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 2A:
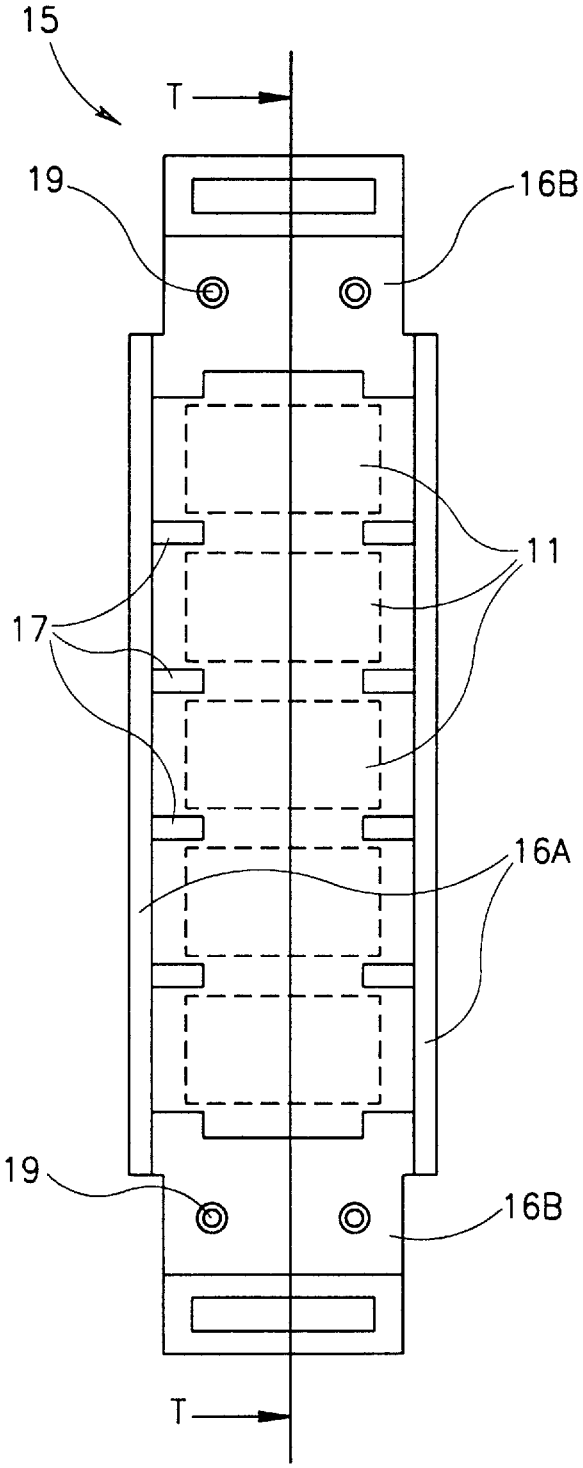
FIG. 2A is a partial side-sectional view of the electrical heating device of FIG. 1A, taken along line Q—Q therein, showing a pictorial representation of the positioning frame of the electrical heating device.
Figure 2B:
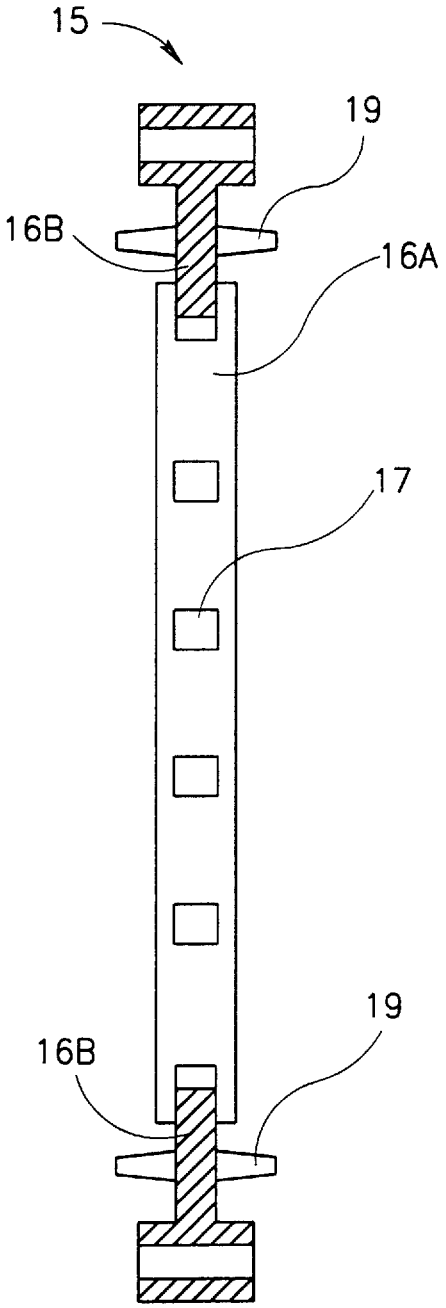
FIG. 2B is a side-sectional view of the positioning frame of FIG. 2A, taken along line T—T therein.
Figure 3:
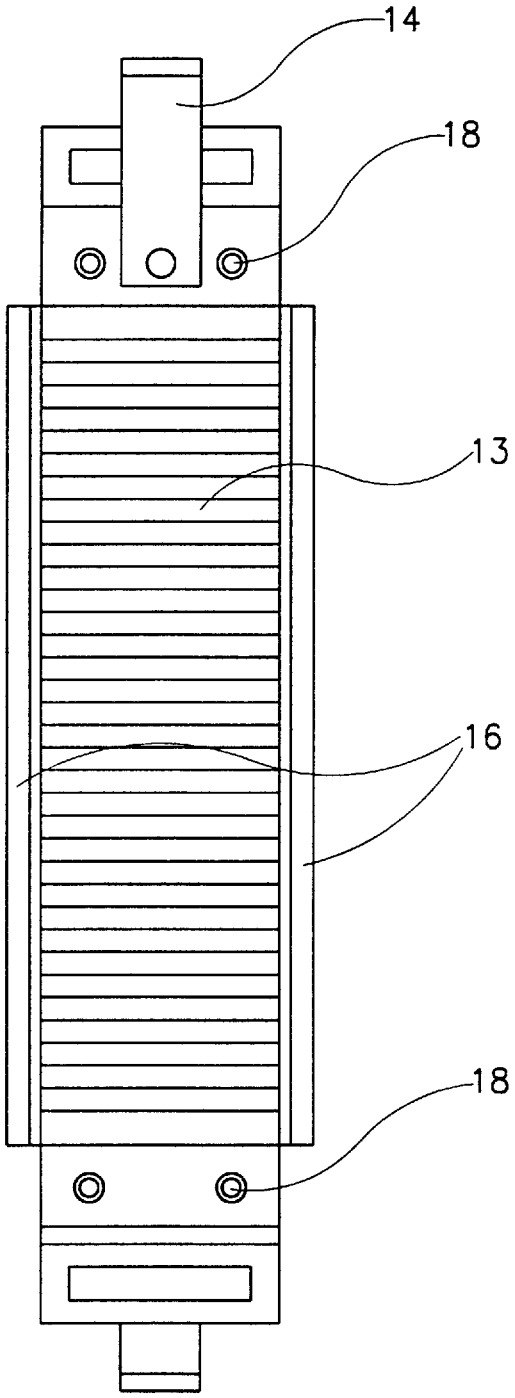
FIG. 3 is a front view of the electrical heating device of FIG. 1A, taken in the direction of arrow P therein.

Referring now to FIG. 1A through 3, there is shown an electrical heating device referred to generally as 10, constructed in accordance with a preferred embodiment of the present invention. Electrical heating device 10 has an array of one or more heating elements 11 which are positive temperature coefficient (PTC) thermistors. They are fabricated with preferably parallel, generally flat, surfaces on opposing faces 22, which are coated with a conductive metal such as aluminum, to serve as thermal and electrical contact surfaces. On opposing sides of heating elements 11 are heat radiator units, referred to generally as 20, each of which includes a plate 12 and cooling fins 13 extending generally transversely therefrom. Radiator units 20 are made of material that is a good thermal and electrical conductor, such as aluminum. The plates 12 of the radiator units 20 are fabricated with flat inward-facing surfaces 24 to serve as thermal and electrical contact surfaces. The plates 12 are positioned so that the inward-facing contact surfaces are generally parallel to and in touching contact with the outward-facing contact surfaces of the heating elements 11 so as to define thermal and electrical interfaces therewith. The conduction across the interfaces may optionally be improved by the use of a thermally and electrically conductive adhesive, such as Ceramabond TM5526, a high-temperature adhesive produced by Aremco Products, Inc. of Ossining, N.Y. 10562, U.S.A., thereat. Attached to the plates 12 are electrodes 14 which allow the heating device 10 to be connected to an electrical circuit. An example of how an electrode 14 may be mounted on a plate 12 is shown in FIG. 3. The direct application of electrical current to the thermistor heating elements 11 via the electrodes 14 and the plates 12 serves, inter alia, to minimize the number of components in the present invention, thereby simplifying its design.

The thermistor heating elements 11 convert electrical energy applied thereto to thermal energy. The thermal energy is, in turn, conducted from the heating elements 11 to the cooling fins 13 via the thermal interfaces and the plates 12. Air or other gas flow over the cooling fins 13 removes the heat from the device. As will be appreciated by persons skilled in the art, the direct contact between the heating elements 11 and the radiator units 20 has the advantage of allowing the heat to be transferred with great efficiency. This further simplifies the design of the device.

Figure 1A:
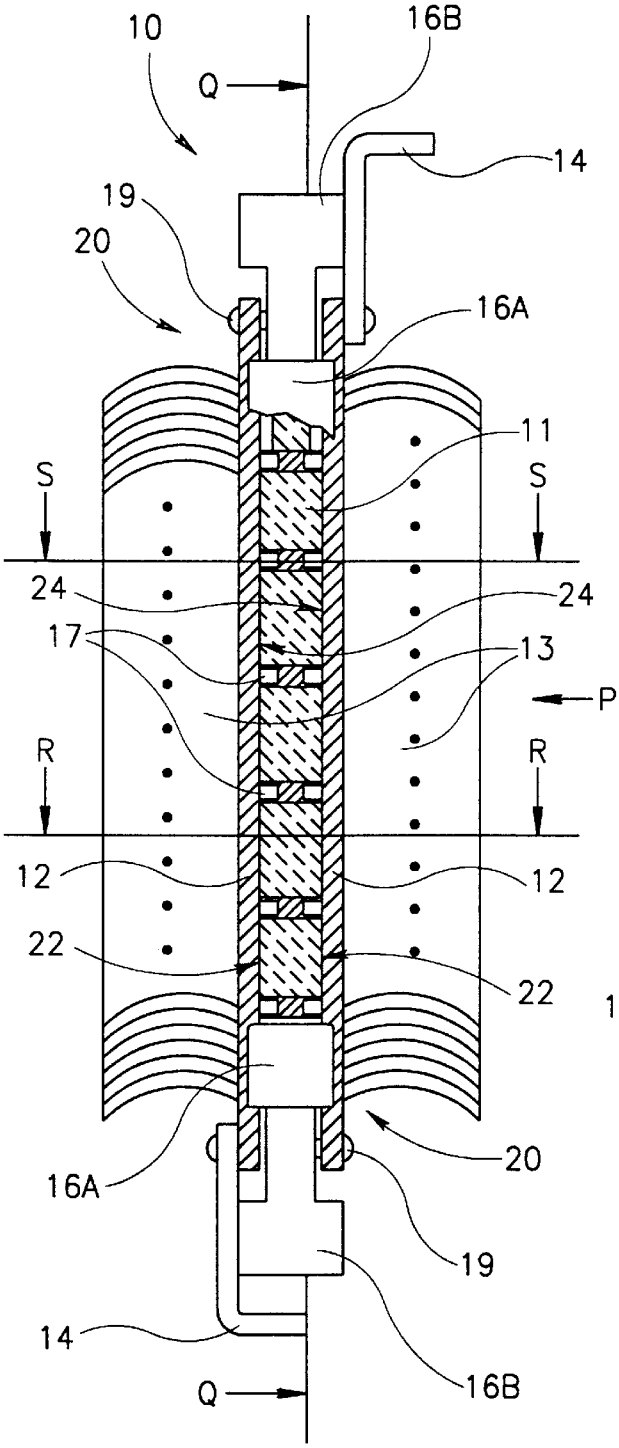
FIG. 1A is a schematic side-sectional view of an electrical heating device constructed and operative in accordance with a preferred embodiment of the present invention.

As seen particularly in FIG. 2A, which is a partial side-sectional view of FIG. 1A, taken along line Q—Q therein, the heating elements 11, shown in FIG. 2A in broken lines, are positioned by an electrically insulating frame 15 which includes longitudinal flanges 16A extending transversely therefrom on both sides of heating elements 11 and end pieces 16B. In accordance with a preferred embodiment of the present invention, the heating device 10 has a plurality of thermistor heating elements 11 arranged in an array wherein they are preferably spaced evenly and are prevented from touching one another by electrically insulating spacers 17 mounted in flanges 16A along the length of the heating device 10. In the present embodiment, spacers 17 are provided by protrusions extending generally inwardly from flanges 16A. As seen in both FIGS. 2A and 2B, pins 19 are provided which position plates 12 of radiator units 20 by engaging holes 18 therein (FIG. 3). Plates 12 of radiator units 20 may be fastened to pins 19 and positioning frame 15 by any suitable means, such as alloy welding or threaded screws or nuts. A side view of plates 12 engaging pins 19 is shown in FIG. 1A.

Figure 1B:
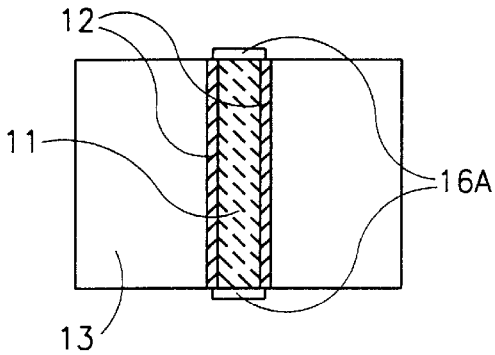
FIGS. 1B and 1C are cross-sectional views of the electrical heating device of FIG. 1A, taken along lines R—R and S—S therein, respectively.
Figure 1C:
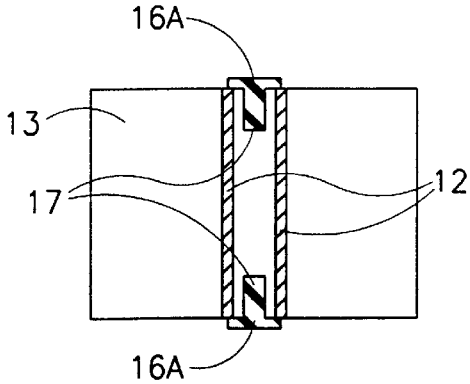

It can be seen from FIG. 2A that flanges 16A and end pieces 16B of positioning frame 15 surround the array of heating elements 11 on four sides. It can further seen from the side-sectional view in FIG. 2B that positioning frame 15 has sufficient depth to enclose heating elements 11. Referring again to FIG. 1A, the top flange 16 of positioning frame 15, shown partially cut away, can be seen to enclose the array of heating elements 11 from above, as drawn, and plates 12 of radiator units 20 can be seen to enclose heating elements 11 on both sides longitudinally, as drawn. The total enclosure of the array of heating elements 11 and the space containing it can be further seen in FIGS. 1B and 1C. FIG. 1B is a side-sectional view of the electrical heating device of FIG. 1A, taken along line R—R therein, which cuts the device through one of the thermistor heating elements 11. FIG. 1C is a cross-sectional view of the electrical heating device of FIG. 1A, taken along line S—S therein, which cuts the device through a pair of spacers 17. In these cross-sectional views, the array of heating elements 11 is seen to be completely enclosed by frame 15 and radiator unit plates 12, thereby preventing heating elements 11 from being exposed to any cooling air or gas flow, so as to protect them from the known "pinch effect."

Referring now to FIG. 3, there is shown a front view of an electrical heating device constructed in accordance with a preferred embodiment of the present invention. In this view is shown one of the radiator units with its plate 12 and fins 13. Plate 12 has holes 18 to engage the pins 19 of positioning frame 15 (FIG. 2A).

It will further be appreciated, by persons skilled in the art that the scope of the present invention is not limited by what has been specifically shown and described hereinabove, merely by way of example. Rather, the scope of the present invention is defined solely by the claims, which follow.

We claim:

1. An electrical heating device comprising:

at least one positive temperature coefficient (PTC) thermistor heating element having generally parallel, flat, outward-facing contact surfaces;

a pair of heat radiation members each formed of a single portion of an electrically and thermally conductive material, defining a plate portion of generally uniform thickness having a generally flat, inward-facing, contact surface for electrically and thermally conductive contact with said outward-facing contact surfaces of said at least one heating element, and a plurality of similar generally outwardly extending parallel cooling fins formed integrally with said plate portion for receiving conducted heat generally uniformly therefrom, and operative to provide a generally uniform transfer of the heat by radiation to a gas passing in heat transfer flow therewith, wherein said cooling fins have free edges;

apparatus for fastening each of said heat radiation members in electrically and thermally conductive contact with one of said flat contact surfaces of said at least one heating element, such that there is provided between each said radiation member and said at least one heating element a single interface only, across an area of which heat and electricity are conducted between said at least one heating element and said radiation members substantially uniformly;

such that said flat contact surfaces of said at least one heating element are held in electrically and thermally conductive contact with said inward-facing contact surfaces thereby to define therewith interfaces;

an enclosing structure formed of a single portion of an electrically and thermally insulating material and having a frame portion for containing a single layer of said at least one heating element and disposed between said plate portions of said heat radiation members so as to prevent a flow of gas from entering therebetween and thus coming into contact with said at least one heating element; and electrodes attached to said heat radiation members, operative to permit flow of electric current therethrough, across said interfaces, and via said at least one heating element, thereby producing thermal energy therein;

wherein, when an electrical current passes through said electrical heating device, thermal energy from said at least one heating element is conducted uniformly across said single interfaces to said heat radiation members.

2. An electrical heating device according to claim 1 wherein said contact surfaces of said at least one heating element are coated with a thermally and electrically conductive metal.

3. An electrical heating device according to claim 1 wherein said apparatus for fastening includes an adhesive which is electrically and thermally conductive applied to said contact surfaces of said at least one heating element and said inward-facing contact surfaces of said plate portions of each said radiation members.

4. An electrical heating device according to claim 1 wherein said at least one heating element includes at least two heating elements arranged between said heat radiation members in a single layer and said enclosing structure further includes electrically insulating spacer portions disposed between said at least two heating elements so as to prevent touching contact therebetween.

* * * * *